US007532164B1

(12) United States Patent
Phillips et al.

(10) Patent No.: US 7,532,164 B1
(45) Date of Patent: May 12, 2009

(54) CIRCULAR POLARIZED ANTENNA

(75) Inventors: James P. Phillips, Lake in the Hills, IL (US); Guangli Yang, Waukegan, IL (US); Robert N. Shaddock, Tempe, AZ (US); Thomas J. Walczak, Woodstock, IL (US)

(73) Assignee: Motorola, Inc., Schaumburg, IL (US)

( * ) Notice: Subject to any disclaimer, the term of this patent is extended or adjusted under 35 U.S.C. 154(b) by 48 days.

(21) Appl. No.: 11/778,790

(22) Filed: Jul. 17, 2007

Related U.S. Application Data

(63) Continuation of application No. 11/749,435, filed on May 16, 2007, now abandoned.

(51) Int. Cl.
*H01Q 1/38* (2006.01)
*H01Q 11/12* (2006.01)

(52) U.S. Cl. ..... 343/700 MS; 343/741

(58) Field of Classification Search ..... 343/700 MS, 343/702, 741–743, 866
See application file for complete search history.

(56) References Cited

U.S. PATENT DOCUMENTS

| | | | | |
|---|---|---|---|---|
| 4,573,053 | A * | 2/1986 | Mori et al. | 342/441 |
| 4,723,305 | A | 2/1988 | Phillips et al. | |
| 5,322,991 | A | 6/1994 | Hanson | |
| 5,541,398 | A | 7/1996 | Hanson | |
| 6,307,512 | B1 | 10/2001 | Geeraert | |
| 6,308,074 | B1 | 10/2001 | Chandra et al. | |
| 6,333,716 | B1 | 12/2001 | Pontoppidan | |
| 6,392,605 | B2 | 5/2002 | Anterow | |
| 6,567,050 | B1 * | 5/2003 | Briggs | 343/741 |
| 6,614,905 | B1 | 9/2003 | Kristensen | |
| 6,650,298 | B2 | 11/2003 | Abbasi et al. | |
| 6,731,246 | B2 * | 5/2004 | Parsche et al. | 343/741 |
| 6,836,246 | B1 | 12/2004 | Kadambi et al. | |
| 6,865,372 | B2 | 3/2005 | Mauney et al. | |
| 6,904,296 | B2 | 6/2005 | Geeraert et al. | |
| 6,919,943 | B2 | 7/2005 | Tsuyuki et al. | |
| 6,922,574 | B2 | 7/2005 | Abbasi et al. | |
| 6,930,644 | B2 | 8/2005 | Konishi et al. | |
| 2001/0031645 | A1 | 10/2001 | Jarrett | |
| 2001/0050646 | A1 | 12/2001 | Anterow | |
| 2002/0032510 | A1 | 3/2002 | Turnbull et al. | |
| 2002/0103006 | A1 | 8/2002 | Doe | |

(Continued)

FOREIGN PATENT DOCUMENTS

| | | | |
|---|---|---|---|
| EP | 1018777 | A2 | 7/2000 |

(Continued)

OTHER PUBLICATIONS

John D. Kraus; "Antennas"; 653 pages, 1988.

*Primary Examiner*—Shih-Chao Chen
(74) *Attorney, Agent, or Firm*—Roland K. Bowler, II

(57) ABSTRACT

A circular polarized signal receiving antenna (100) including an active element having first and second ends separated by a gap, a dimension of the active element, between the first and second ends thereof, corresponding to approximately one wavelength of a resonant operating frequency of the antenna. A feed-point is coupled to the active element, wherein the feed-point is located approximately one-quarter of the wavelength from the first end of the active element and approximately three-quarters of the wavelength from the second end of the active element. In one embodiment, the feed-point is reactively coupled to the active element.

20 Claims, 4 Drawing Sheets

U.S. PATENT DOCUMENTS

| | | | | |
|---|---|---|---|---|
| 2002/0111185 | A1 | 8/2002 | Geeraert et al. | |
| 2002/0160717 | A1 | 10/2002 | Persson et al. | |
| 2003/0003970 | A1 | 1/2003 | Johnson et al. | |
| 2003/0083051 | A1 | 5/2003 | Ntende | |
| 2003/0122726 | A1 | 7/2003 | Abbasi et al. | |
| 2003/0153281 | A1 | 8/2003 | Abbasi et al. | |
| 2003/0222821 | A1 | 12/2003 | Mikkonen et al. | |
| 2004/0178958 | A1* | 9/2004 | Kadambi et al. | 343/700 MS |
| 2004/0196179 | A1 | 10/2004 | Turnbull | |
| 2005/0007336 | A1 | 1/2005 | Albert et al. | |
| 2005/0020236 | A1 | 1/2005 | Mauney et al. | |
| 2005/0024268 | A1 | 2/2005 | McKinzie, III et al. | |
| 2005/0032475 | A1 | 2/2005 | Mauney et al. | |
| 2005/0068289 | A1 | 3/2005 | Diefenbaugh et al. | |
| 2005/0075684 | A1 | 4/2005 | Philips et al. | |
| 2005/0075687 | A1 | 4/2005 | Phillips et al. | |
| 2005/0075688 | A1 | 4/2005 | Toy et al. | |
| 2005/0075689 | A1 | 4/2005 | Toy et al. | |
| 2005/0075692 | A1 | 4/2005 | Schommer et al. | |
| 2005/0159107 | A1 | 7/2005 | Mauney et al. | |
| 2005/0174290 | A1 | 8/2005 | Huang | |
| 2005/0181750 | A1 | 8/2005 | Pinks | |
| 2008/0136720 | A1* | 6/2008 | Parsche et al. | 343/741 |

FOREIGN PATENT DOCUMENTS

| | | | |
|---|---|---|---|
| EP | 1020947 | A2 | 7/2000 |
| EP | 1020948 | A1 | 7/2000 |
| EP | 1028445 | A2 | 8/2000 |
| EP | 1122815 | A2 | 8/2001 |
| EP | 1213838 | A1 | 6/2002 |
| EP | 1231671 | A2 | 8/2002 |
| EP | 1271793 | A2 | 1/2003 |
| EP | 1500991 | A2 | 1/2005 |
| EP | 1223432 | B1 | 3/2005 |
| JP | 05275918 | | 10/1993 |
| JP | 2002-111365 | | 4/2002 |
| WO | 0131739 | A1 | 5/2001 |
| WO | 03069785 | A2 | 8/2003 |

* cited by examiner

CIRCULAR POLARIZED ANTENNA

CROSS-REFERENCE TO RELATED APPLICATIONS

The present application is a continuation of co-pending U.S. application Ser. No. 11/749,435 filed on 16 May 2007 and claims benefits provided under 35 U.S.C. 120.

FIELD OF THE DISCLOSURE

The present disclosure relates generally to antennas for portable electronic devices, and more specifically to circular polarized antennas, for example, dual-strip transmission line antennas, capable of receiving satellite signals having circular polarized waves and methods therefor.

BACKGROUND

Satellite-to-earth navigation and communication systems have been operational for many years. These systems often use communication signals having circularly polarized electromagnetic waves. Due to the large distances involved, hand-held wireless communication devices that interface with satellite-to-earth communication and navigation systems require relatively efficient antennas. The most common types of antennas suitable for these systems include Quadrafilar Helix antennas and square micro-strip patch antennas. For portable and especially hand-held applications, the continual challenge is to provide an antenna with good efficiency and sufficient compactness to fit within relatively small form factors.

The various aspects, features and advantages of the disclosure will become more fully apparent to those with ordinary skill in the art, on a careful consideration of the following Detailed Description and the accompanying drawings. The drawings have been simplified for clarity and are not necessarily drawn to scale.

DETAILED DESCRIPTION

The disclosure concerns antennas suitable for receiving circular polarized signals. Such signals are transmitted by satellites orbiting the earth, among other transmitters. For example, the NAVSTAR Global Positioning System (GPS) satellites currently transmit right-hand circular polarized signals, and some commercial communication satellites transmit left-hand circular polarized signals.

The antenna generally comprises an active element separated from a ground element by a dielectric. The active element is arranged in a partially closed configuration wherein opposite ends thereof are separated by a gap. In one embodiment, the active element has a dimension between the first and second ends thereof corresponding to approximately a single wavelength of the resonant operating frequency of the antenna. In other embodiments, the dimensional length of the active element may correspond to other whole or fractional multiples of the resonant wavelength. Various exemplary embodiments of the antenna and applications thereof are discussed below.

Figure 1:
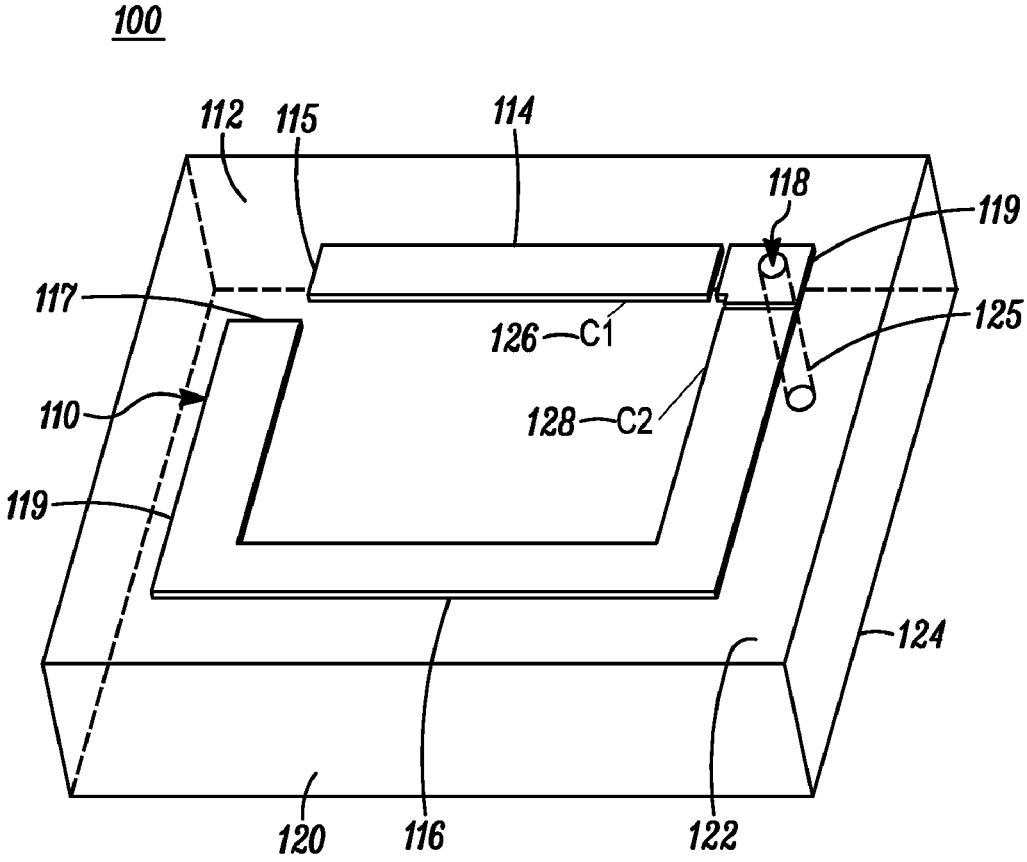
FIG. 1 is a circular polarized signal receiving antenna.

In FIG. 1, the antenna 100 comprises an active element 110 arranged in a partially closed configuration wherein opposite ends of the active element are separated by a gap 112. The active element, or radiating element, is typically a highly conductive material such as a non-oxidized metal. In one embodiment, the active element is arranged in a polygonal configuration. In FIG. 1, for example, the active element has a substantially square configuration. The shape is 'substantially' square due to the gap 112 located in the corner thereof. In other embodiments, the active element may have a substantially close-ended curved configuration, for example, a circular shape. The active element may also assume other shapes in other embodiments.

In FIG. 1, the active element comprises a first transmission-line section 114 and a second transmission-line section 116 extending from the feed-point 118, wherein the gap 112 is formed between opposite ends of the sections. In embodiments where the first and second transmission-line sections have substantial width, the active element sections will have substantially parallel inner and out perimeter portions. In these embodiments, the outer perimeter portions constitute the dimension of the active element corresponding to approximately some multiple of the wavelength of the resonant operating frequency of the antenna.

In one embodiment, the first transmission-line section 114 has a dimension between opposite ends thereof that is approximately one-quarter of the wavelength of the resonant operating frequency of the antenna, and the second transmission-line section 116 has a dimension between opposite ends thereof that is approximately three-quarters of the wavelength of the resonant operating frequency of the antenna. Thus in the exemplary embodiment where the active element has a substantially square configuration, each side has a length that is approximately one-quarter (¼) of the wavelength of the resonant operating frequency of the antenna.

In FIG. 1, the active element 110 is disposed adjacent to a dielectric 120 that separates the active element from a ground element. In one application the ground element is part of circular polarized signal receiving device, for example, a ground plane portion within a receiver housing as discussed further below. The dielectric may be a gaseous material, for example, air. Alternatively, the dielectric is a solid material with insulating properties, for example, a ceramic material. In FIG. 1, where a solid dielectric material is employed, the active element may be disposed or formed on a surface 122 of the dielectric and the ground element may be disposed or formed on an opposite surface 124 thereof. In FIG. 1, the active element is substantially parallel to the ground element, though in other embodiments the relationship between these elements may be non-parallel. In some embodiments, the reactive element is printed or otherwise deposited on the dielectric.

The antenna also comprises a feed-point coupled to the active element. The feed-point is generally coupled to the active element between the ends thereof forming the gap. In FIG. 1, the feed-point 118 is located approximately one-quarter (¼) of the wavelength from the end 115 of the active element and approximately three-quarters (¾) of the wavelength from the other end 117 of the active element. In FIG. 1, the feed-point 118 is coupled to a feed conductor 125 disposed through the dielectric 120, wherein the feed conductor is directed away from the active element. In some embodiments, the feed conductor 125 is capacitively coupled to the feed-point.

The right or left handedness of the circular polarization of the antenna is generally dependent on the geometrical configuration of the active element. In FIG. 1, the antenna 100 is a left-hand circular polarized antenna. Locating the feed-point in the opposite corner 119 relative to the gap will configure the antenna as a right-hand circular polarized antenna.

Figure 2:
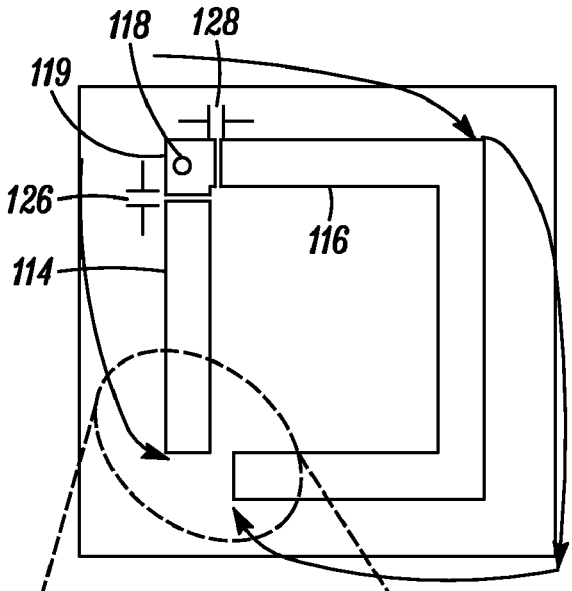
FIG. 2 is another view of a circular polarized signal receiving antenna.

In some embodiments, the feed-point is reactively coupled to the active element. Generally, the reactance of the coupling may be capacitive and/or inductive. In FIGS. 1 and 2, the feed point is capacitively coupled to the active element. In one embodiment, illustrated in FIG. 2, the feed-point 118 is reactively coupled to the first (¼ wavelength) transmission line section 114 with a capacitance (C1) 126 that is approximately two times greater than a capacitance (C2) 128 with which the feed-point is coupled to the second (¾ wavelength) transmission line section 116. In FIG. 2, the feed-point 118 is located at a corner section 119 of the active element. The capacitances between the feed-point 118 and the first and second transmission-line sections 114 and 116 are embodied as gaps 126 and 128 between the corner section 119 and the respective transmission line sections. The reactive coupling between the feed-point and active element provides impedance matching and may be used to adjust characteristics of the electric field as discussed further below.

Figure 3:
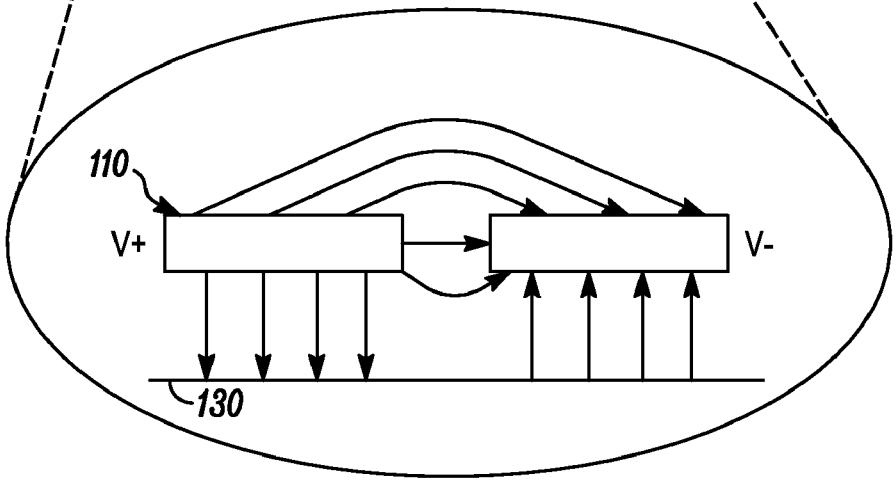
FIG. 3 is a corner view of the antenna of FIG. 2.

In FIG. 3, the active element is viewed in the vicinity of the gap. FIG. 3 also illustrates the nature of the electric field between the active element 110 and the ground plane 130. In the exemplary embodiment, where the dimensional length of the active element is approximately equal to the resonant wavelength of the antenna, the electric fields emanating from the opposite ends of the active element are approximately one hundred-eighty degrees (180°) out of phase. This 180 degree phase shift difference across the gap between the ends of the active element enhances the electric field of the antenna, and particularly causes the electric field to bloom outwardly away from the active element. The 180 degree phase shift also increases antenna efficiency. The phase difference of the electric filed at the opposite ends of the active element in the vicinity of the gap may be adjusted by appropriate selection or adjustment of the reactive coupling between the feed point and the active element, an example of which is discussed below.

Figure 4:
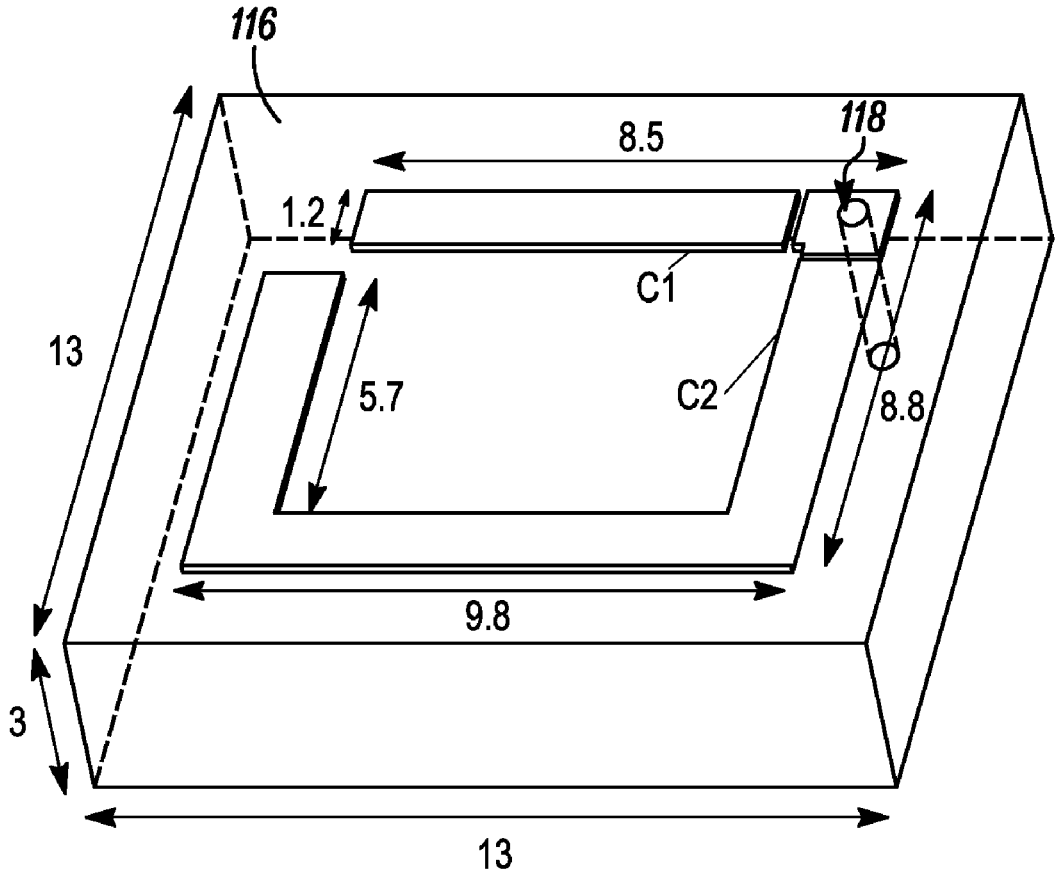
FIG. 4 is a particular circular polarized signal receiving antenna implementation.

In one particular application, the antenna is configured to receive a circular polarized signal having a frequency between approximately 2332 MHz and approximately 2345 MHz. FIG. 4 illustrates exemplary dimensions (in mm) for the active element and a dielectric, which in one embodiment is a ceramic material having a relative dielectric constant $\in_r$=37 and a dielectric loss tangent=0.00015. In this particular embodiment, the active element has a length dimension corresponding to a single wavelength of the resonant frequency of the antenna. The feed point 118 is located approximately one-quarter of the wavelength from the one end of the active element and approximately three-quarters of the wavelength from the other end of the active element, wherein the ends are separated by the gap 116. Thus each arm of the active element is approximately one-quarter (¼) the resonant frequency wavelength. The feed-point is reactively coupled to the active element by a 10 pF capacitor C1 and a 3.6 pF capacitor C2. The feed conductor is coupled to the feed point by a 0.7 pF series capacitor.

Figure 5:
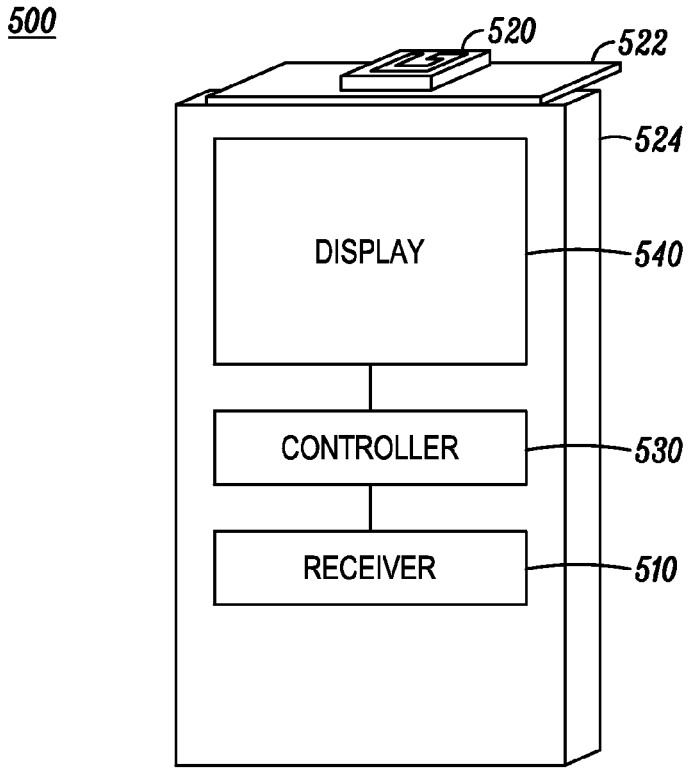
FIG. 5 is a portable circular polarized signal receiver device.

FIG. 5 illustrates a portable hand-held circular polarized signal receiving device 500, for example, a satellite positioning system (SPS) signal receiver and/or a satellite-based media broadcast signal receiver. More generally, the device may be a multifunction device, for example, a wireless communication telephone handset having an SPS receiver and/or a satellite radio broadcast signal receiver. Thus in some embodiments, the device may include both right and left-handed circular polarized signal receivers with corresponding antennas, wherein one receiver receives SPS navigation signals and the other receives satellite based media broadcast signals.

In FIG. 5, the device 500 comprises a circular polarized signal receiver 510, and an antenna 520 communicably coupled to the receiver. In one embodiment, the antenna is of the type illustrated in FIGS. 1 and 2 above, or a variation thereof having its geometry and scale optimized for receiving a particular signal of interest. The antenna is generally located in an upper portion of the device wherein the active element faces toward the upper portion, particularly in applications where the signals are broadcast by one or more satellites. In FIG. 5, the antenna is disposed on a ground plane element 522 positioned substantially transversely on an end of a printed circuit board (PCB) 524. The angle of the ground plane element relative to the PCB may be configured to optimize reception of space vehicle originated signals based on how the user would most likely hold the device, for example, against the ear in two-way communications applications.

In FIG. 5, the device 500 also includes a controller 530, for example, a programmable digital processor, communicably coupled to the receiver 510. The controller is also typically coupled to other elements of the device, for example, to a user interface, other receivers, short and/or long range transceivers, etc. In one embodiment, the user interface includes a display 540 for displaying information, for example, an operating system interface and/or an application interface. Exemplary applications include positioning or navigation applications, media player/playback applications and communications related applications, among others.

Figure 6:
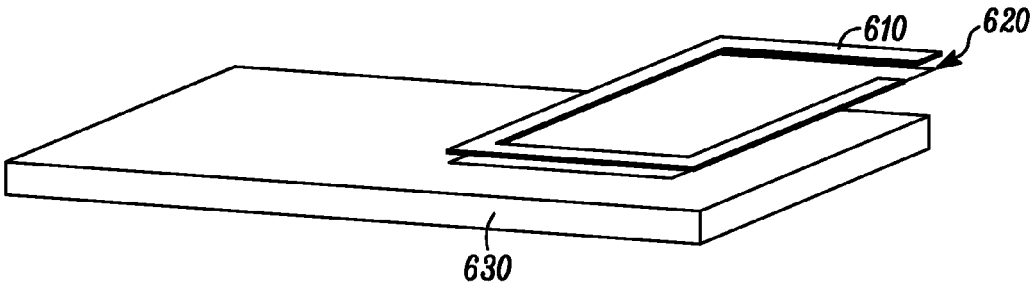
FIG. 6 is an alternative antenna configuration.

In an alternative embodiment, the antenna or a portion thereof is integrated with the structure of the display device. In FIG. 6, the active element 610 of the antenna is installed around a periphery of a display device 620. In this configuration, the ground plane may be part of the display, or the ground plane may be disposed on or be a part of the PCB 630. For circular polarized signal receiving applications, it may be necessary for the length dimension of the antenna to be an integer or non-integer multiple of the wavelength of the resonant frequency of the antenna, depending on the wavelength of the resonant frequency and the periphery of the display about which the active element is disposed. In another embodiment, the active element is disposed on a backside of the display, wherein the active element resides between the display and the PCB.

Generally, the active element loop may be interrupted at one or more locations by reactance elements to cause the resonant frequency or frequencies and impedance(s) to coincide with requirements of the wireless device. The reactive elements may be fixed or they may be under variable control of the host device. In some applications, the circular polarized antenna is capable of being de-activated when other antennas are active. Integrating the antenna or a portion thereof with the display reduces the likelihood that the antenna will not be obstructed by the user, since the user generally handles the device in a manner that provides a clear view of the display with which the antenna is integrated.

While the present disclosure and the best modes thereof have been described in a manner establishing possession by the inventors and enabling those of ordinary skill to make and use the same, it will be understood and appreciated that there are equivalents to the exemplary embodiments disclosed herein and that modifications and variations may be made thereto without departing from the scope and spirit of the inventions, which are to be limited not by the exemplary embodiments but by the appended claims.

What is claimed is:

1. A circular polarized signal receiving antenna, comprising:

an active element having first and second ends separated by a gap, the active element having a dimension between the first and second ends thereof corresponding to approximately one wavelength of a resonant operating frequency of the antenna;

a feed-point coupled to the active element, the feed-point located approximately one-quarter of the wavelength from the first end of the active element and approximately three-quarters of the wavelength from the second end of the active element, the feed-point is reactively coupled to the active element.

2. The antenna of claim 1, a ground plane, a dielectric disposed between the active element and the ground plane, the active element substantially parallel to the ground plane.

3. The antenna of claim 2, the dielectric is a solid substrate having opposite sides, the active element is disposed on one side of the substrate and the ground plane is disposed on the opposite side of the substrate, the feed-point is coupled to a feed conductor disposed through the substrate.

4. The antenna of claim 1, the active element comprises a first transmission-line section having a dimension between opposite ends thereof that is approximately one-quarter of the wavelength of the resonant operating frequency of the antenna, a second transmission-line section having a dimension between opposite ends thereof that is approximately three-quarters of the wavelength of the resonant operating frequency of the antenna, the gap formed between the one end of the first and second transmission-line sections, the feed-point reactively coupled to the opposite end of the first and second transmission-line sections.

5. The antenna of claim 4, the feed-point is reactively coupled to the first transmission line section with a capacitance that is approximately two times greater than a capacitance with which the feed-point is coupled to the second transmission line section.

6. The antenna of claim 4, the first and second transmission line sections are arranged in a polygonal configuration.

7. The antenna of claim 6, the polygonal configuration is substantially square.

8. The antenna of claim 1, the feed-point is reactively coupled to the active element by a capacitive element.

9. The antenna of claim 1, the active element arranged in a substantially partially closed configuration, the active element having substantially parallel inner and out perimeters, the outer perimeter having a dimension between the first and second ends of the active element corresponding to approximately one wavelength of the resonant operating frequency of the antenna.

10. A portable hand-held circular polarized signal receiving device, comprising:

a receiver;

an antenna communicably coupled to the receiver, the antenna including an active element having opposite ends separated by a gap, a dimension between the opposite ends of the active element corresponding to a approximately one wavelength of a resonant operating frequency of the antenna;

a feed-point coupled to the active element, the feed-point located one-quarter of the wavelength from one end of the active element and three-quarters of the wavelength from the opposite end of the active element, the feed-point is reactively coupled to the active element.

11. The device of claim 10, the active element comprises a first transmission-line section having a dimension between opposite ends thereof that is approximately one-quarter of the wavelength of the resonant operating frequency of the antenna, a second transmission-line section having a dimension between opposite ends thereof that is approximately three-quarters of the wavelength of the resonant operating frequency of the antenna, the gap formed between the one end of the first and second transmission-line sections, the feed-point reactively coupled to the opposite end of the first and second transmission-line sections.

12. The device of claim 11, the feed-point is reactively coupled to the first transmission line section with a capacitance that is approximately two times greater than a capacitance with which the feed-point is coupled to the second transmission line section.

13. The device of claim 11, the first and second transmission line sections are arranged in a polygonal configuration.

14. The device of claim 11, further comprising a ground plane disposed within the housing adjacent the active element, a dielectric substrate separating the active element and the ground plane, the antenna located in an upper portion of the device and the active element facing toward the upper portion.

15. The device of claim 10, further comprising a housing having an upper and lower portions, the active element disposed within the housing nearer the upper portion of the housing than the lower portion thereof, a ground plane disposed within the housing adjacent the active element, a dielectric substrate separating the active element and the ground plane.

16. The device of claim 15, the feed-point is a conductive element disposed on the same side of the substrate as the active element, the feed-point is coupled to a feed conductor disposed through the substrate.

17. The device of claim 16, the feed-point is capacitively coupled to the active element.

18. The device of claim 11, the feed-point is reactively coupled to the active element by a capacitive element.

19. The device of claim 18, the active element comprises a first transmission line section having a dimension that is approximately one-quarter of the wavelength of the resonant operating frequency of the antenna and a second transmission line section having a dimension that is approximately three-quarters of the wavelength of the resonant operating frequency of the antenna, the feed-point is reactively coupled to the first transmission line section with a capacitance that is greater than a capacitance with which the feed-point is coupled to the second transmission line section.

20. The device of claim 10, a controller communicably coupled to the receiver, a display device communicably coupled to the controller, the active element of the antenna is integrated with the display device.

* * * * *